US011821330B1

(12) United States Patent
Guglielmin et al.

(10) Patent No.: US 11,821,330 B1
(45) Date of Patent: Nov. 21, 2023

(54) APERTURE PATTERN FOR GAS TURBINE ENGINE COMPONENT WITH INTEGRAL ALIGNMENT FEATURE

(71) Applicant: Pratt & Whitney Canada Corp., Longueuil (CA)

(72) Inventors: Nicholas Guglielmin, Toronto (CA); Kenneth Parkman, Halton Hills (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 17/746,541

(22) Filed: May 17, 2022

(51) Int. Cl.
*F01D 25/24* (2006.01)
*F01D 25/28* (2006.01)

(52) U.S. Cl.
CPC ..... *F01D 25/243* (2013.01); *F01D 25/28* (2013.01); *F05D 2230/64* (2013.01); *F05D 2230/70* (2013.01); *F05D 2240/14* (2013.01); *F05D 2260/31* (2013.01)

(58) Field of Classification Search
CPC ..... F01D 25/24; F01D 25/246; F01D 25/243; F05D 2230/64; F05D 2230/70; F05D 2260/31; F05D 2240/14
See application file for complete search history.

(56) References Cited

U.S. PATENT DOCUMENTS

| | | | | |
|---|---|---|---|---|
| 8,721,278 | B2 * | 5/2014 | Shteyman | F01D 25/30 415/214.1 |
| 10,190,439 | B2 | 1/2019 | Korshikov | |
| 10,247,038 | B2 * | 4/2019 | Kappes | F01D 21/045 |
| 2012/0328365 | A1 * | 12/2012 | Care | F01D 21/045 403/337 |
| 2013/0202430 | A1 * | 8/2013 | Gaudry | F02C 7/32 415/214.1 |
| 2020/0300167 | A1 * | 9/2020 | Von Berg | F01D 25/243 |

* cited by examiner

*Primary Examiner* — David E Sosnowski
*Assistant Examiner* — Maxime M Adjagbe
(74) *Attorney, Agent, or Firm* — Getz Balich LLC

(57) ABSTRACT

A structure for a gas turbine engine includes a first engine component, a second engine component and fasteners. The component apertures include first fastener apertures and intergroup apertures. The first fastener apertures are arranged into a plurality of groups. The first group is formed by $N_1$-number of the first fastener apertures. The second group is formed by $N_2$-number of the first fastener apertures where the $N_2$-number is different than the $N_1$-number. Each of the intergroup apertures is disposed circumferentially between and adjacent a respective circumferentially neighboring pair of the groups. The second engine component includes a surface and second fastener apertures. The surface axially engages the first engine component and covers the intergroup apertures. The fasteners attach the first engine component and the second engine component together. Each of the fasteners is mated with one of the first fastener apertures and one of the second fastener apertures.

20 Claims, 9 Drawing Sheets

APERTURE PATTERN FOR GAS TURBINE ENGINE COMPONENT WITH INTEGRAL ALIGNMENT FEATURE

TECHNICAL FIELD

This disclosure relates generally to a gas turbine engine and, more particularly, to a mechanical joint between engine components.

BACKGROUND INFORMATION

A stationary structure for a gas turbine engine may include a plurality of engine cases connected together at a mechanical joint such as a bolted flange joint. To facilitate proper alignment between the engine cases, one or both of the engine cases may include an alignment feature. Various types of alignment features are known in the art. While these known alignment features have various benefits, there is still room in the art for improvement. In particular, there is a need in the art for a mechanical joint between engine components with integral alignment to reduce stationary structure complexity and increase stationary structure strength.

SUMMARY

According to an aspect of the present disclosure, a structure is provided for a gas turbine engine. This structure includes a first engine component, a second engine component and a plurality of fasteners. The first engine component includes a plurality of component apertures equally spaced circumferentially about an axis. The component apertures include a plurality of first fastener apertures and a plurality of intergroup apertures. The first fastener apertures are arranged into a plurality of groups including a first group and a second group. The first group is formed by $N_1$-number of the first fastener apertures. The second group is formed by $N_2$-number of the first fastener apertures where the $N_2$-number is different than the $N_1$-number. Each of the intergroup apertures is disposed circumferentially between and adjacent a respective circumferentially neighboring pair of the groups. The second engine component includes a surface and a plurality of second fastener apertures. The surface axially engages the first engine component and covers the intergroup apertures. The fasteners attach the first engine component and the second engine component together. Each of the fasteners is mated with a respective one of the first fastener apertures and a respective one of the second fastener apertures.

According to another aspect of the present disclosure, another structure is provided for a gas turbine engine. This structure includes a first engine component, a second engine component and a plurality of fasteners. The first engine component includes a first component mount and a plurality of component apertures arranged circumferentially about an axis. The first component mount extends circumferentially about the axis. Each of the component apertures extends axially through the first component mount. The component apertures include a plurality of first fastener apertures and a spacer aperture. A first of the first fastener apertures is circumferentially between and adjacent a second of the first fastener apertures and the spacer aperture. A circumferential spacing between the first of the first fastener apertures and the second of the first fastener apertures is equal to a circumferential spacing between the first of the first fastener apertures and the spacer aperture. The second engine component includes a surface and a plurality of second fastener apertures. The surface circumferentially and radially overlaps the spacer aperture. The fasteners attach the first engine component and the second engine component together. Each of the fasteners are mated with a respective one of the first fastener apertures and a respective one of the second fastener apertures.

According to still another aspect of the present disclosure, another structure is provided for a gas turbine engine. This structure includes a first engine component, a second engine component and a plurality of fasteners. The first engine component includes a plurality of component apertures equally spaced circumferentially about an axis. The component apertures include a plurality of first fastener apertures and a plurality of intergroup apertures. The first fastener apertures are arranged into a plurality of groups including a first group and a second group. The first group is formed by $N_1$-number of the first fastener apertures. The second group is formed by $N_2$-number of the first fastener apertures where the $N_2$-number is different than the $N_1$-number. Each of the intergroup apertures is disposed circumferentially between and adjacent a respective circumferentially neighboring pair of the groups. Each of the intergroup apertures is configured to be empty during operation of the gas turbine engine. The second engine component includes a plurality of second fastener apertures. The fasteners attach the first engine component and the second engine component together. Each of the fasteners is mated with a respective one of the first fastener apertures and a respective one of the second fastener apertures.

The spacer aperture may be circumferentially between and adjacent the first of the first fastener apertures and a third of the first fastener apertures. The circumferential spacing between the first of the first fastener apertures and the spacer aperture may be equal to a circumferential spacing between the spacer aperture and the third of the first fastener apertures.

The third of the first fastener apertures may be circumferentially between and adjacent the spacer aperture and a fourth of the first fastener apertures. The circumferential spacing between the third of the first fastener apertures and the spacer aperture may be equal to a circumferential spacing between the third of the first fastener apertures and the fourth of the first fastener apertures.

The component apertures may also include a plurality of intergroup apertures. The first fastener apertures may be arranged into a plurality of groups including a first group and a second group. The first group may be formed by $N_1$-number of the first fastener apertures including the first of the first fastener apertures and the second of the first fastener apertures. The second group may be formed by $N_2$-number of the first fastener apertures where the $N_2$-number is different than the $N_1$-number. Each of the intergroup apertures may be disposed circumferentially between and adjacent a respective circumferentially neighboring pair of the groups. The intergroup apertures may include the spacer aperture.

The first engine component may be configured as an engine case.

The first engine component may be configured as or otherwise include a mount. The mount may extend circumferentially about the axis. Each of the component apertures may extend axially through the mount.

A first of the intergroup apertures may be a threaded aperture.

A first of the intergroup apertures may be configured to be empty during operation of the gas turbine engine.

A first of the intergroup apertures may be configured to mate with a tool during disassembly of the structure where the tool threads into the first of the intergroup apertures and presses axially against the surface.

The $N_1$-number may be an even number.

The $N_2$-number may be an odd number.

The first engine component may be configured with a NT-number of the first fastener apertures. The NT-number may be an odd number.

The groups may also include a third group. The third group may be formed by $N_3$-number of the first fastener apertures. The $N_3$-number may be an even number.

The groups may also include a third group. The third group may be formed by $N_3$-number of the first fastener apertures. The $N_3$-number may be different than the $N_2$-number.

The intergroup apertures may include a first intergroup aperture, a second intergroup aperture and a third intergroup aperture. The first intergroup aperture may be disposed circumferentially between and adjacent the first group and the second group. The second intergroup aperture may be disposed circumferentially between and adjacent the first group and the third group. The third intergroup aperture may be disposed circumferentially between and adjacent the second group and the third group.

The $N_3$-number may be equal to the $N_1$-number.

The intergroup apertures may include a first intergroup aperture, a second intergroup and a third intergroup aperture. The first intergroup aperture may be $X_1$-number of degrees from the second intergroup aperture about the axis. The first intergroup aperture may be $X_2$-number of degrees from the third intergroup aperture about the axis where the $X_2$-number is equal to the $X_1$-number.

The second intergroup aperture may be $X_3$-number of degrees from the third intergroup aperture about the axis. The $X_3$-number may be within plus or minus five degrees of the $X_1$-number.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
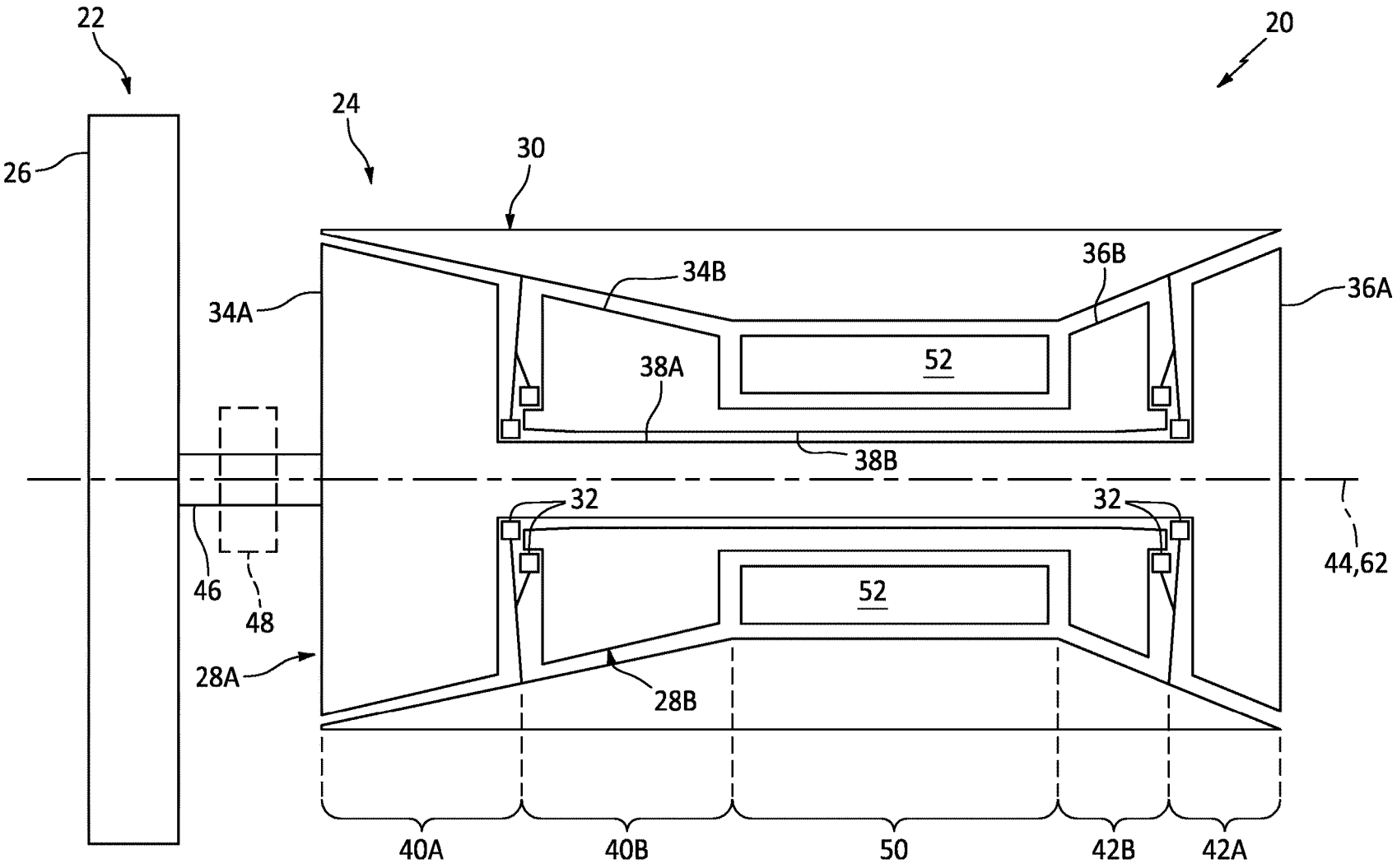
FIG. 1 is a schematic illustration of a gas turbine engine.

FIG. 1 schematically illustrates a gas turbine engine 20 for an aircraft. This gas turbine engine 20 may be included within a propulsion system for the aircraft. The gas turbine engine 20, for example, may be configured as a turbofan gas turbine engine, a turbojet gas turbine engine, a turboprop gas turbine engine or a turboshaft gas turbine engine. The gas turbine engine 20 may alternatively be included within an electrical power generation system for the aircraft. The gas turbine engine 20, for example, may be configured as an auxiliary power unit (APU). The gas turbine engine 20 of the present disclosure, however, is not limited to the foregoing exemplary gas turbine engine types. Furthermore, the gas turbine engine 20 may also be configured for non-aircraft applications. The gas turbine engine 20, for example, may be configured as a (e.g., ground-based) industrial gas turbine engine for an electrical power generation system. The gas turbine engine 20 of the present disclosure may be configured with a single spool, with two spools (e.g., see FIG. 1), or with more than two spools depending on, for example, power requirements.

The gas turbine engine 20 of FIG. 1 includes a mechanical load 22 and a gas turbine engine core 24 configured to drive rotation of the mechanical load 22. The mechanical load 22 may be configured as or otherwise include a rotor 26 of the gas turbine engine 20. The mechanical load 22, for example, may be configured as a bladed propulsor rotor for the aircraft propulsion system. Examples of the propulsor rotor include, but are not limited to: a fan rotor for the turbofan gas turbine engine; a compressor rotor for the turbojet gas turbine engine; a propeller rotor for the turboprop gas turbine engine; and a helicopter rotor (e.g., a main rotor) for the turboshaft gas turbine engine. The mechanical load 22 may alternatively be configured as a generator rotor for the power generation system.

The engine core 24 of FIG. 1 includes one or more rotating structures 28A and 28B (generally referred to as "28") (e.g., spools) and a stationary structure 30. This engine core 24 also includes a plurality of bearings 32 rotatably mounting the rotating structures 28A and 28B to the stationary structure 30.

The first (e.g., low speed) rotating structure 28A includes a first (e.g., low pressure (LP)) compressor rotor 34A, a first (e.g., low pressure) turbine rotor 36A and a first (e.g., low speed) shaft 38A. The first compressor rotor 34A is arranged within and part of a first (e.g., low pressure) compressor section 40A of the engine core 24. The first turbine rotor 36A is arranged within and part of a first (e.g., low pressure) turbine section 42A of the engine core 24. The first shaft 38A extends axially along a rotational axis 44 between and is connected to the first compressor rotor 34A and the first turbine rotor 36A, where the first rotating structure 28A is rotatable about the rotational axis 44.

The first rotating structure 28A may also be rotatably coupled to the mechanical load 22 and its rotor 26. The mechanical load rotor 26, for example, may be coupled to the first rotating structure 28A through a direct drive coupling. This direct drive coupling may be configured as or otherwise include an output shaft 46. With such a direct drive coupling, the mechanical load rotor 26 and the first rotating structure 28A may rotate at a common (e.g., the same) rotational speed. Alternatively, the mechanical load rotor 26 may be coupled to the first rotating structure 28A through a geartrain 48 (see dashed line); e.g., a transmission. This geartrain 48 may be configured as an epicyclic geartrain. With such a geared coupling, the mechanical load rotor 26 may rotate at a different (e.g., slower) rotational speed than the first rotating structure 28A.

The second (e.g., high speed) rotating structure 28B includes a second (e.g., high pressure (HP)) compressor rotor 34B, a second (e.g., high pressure) turbine rotor 36B and a second (e.g., high speed) shaft 38B. The second compressor rotor 34B is arranged within and part of a second (e.g., high pressure) compressor section 40B of the engine core 24. The second turbine rotor 36B is arranged within and part of a second (e.g., high pressure) turbine section 42B of the engine core 24. The second shaft 38B extends axially along the rotational axis 44 between and is connected to the second compressor rotor 34B and the second turbine rotor 36B, where the second rotating structure 28B is rotatable about the rotational axis 44. The second rotating structure 28B of FIG. 1 and its second shaft 38B axially overlap and circumscribe the first shaft 38A; however, the engine core 24 of the present disclosure is not limited to such an exemplary arrangement.

The stationary structure 30 is configured to at least partially or completely house the first compressor section 40A, the second compressor section 40B, a combustor section 50 of the engine core 24, the second turbine section 42B and the first turbine section 42A, where the engine sections 40A, 40B, 50, 42B and 42A may be arranged sequentially along the rotational axis 44 between an airflow inlet to the gas turbine engine 20 and an exhaust from the gas turbine engine 20. The stationary structure 30 of FIG. 1 axially overlaps and extends circumferentially about (e.g., completely around) the first rotating structure 28A and the second rotating structure 28B.

During operation, air enters the gas turbine engine 20 through the airflow inlet. This air is directed into at least a core flowpath which extends sequentially through the engine sections 40A, 40B, 50, 42B and 42A (e.g., the engine core 24) to the exhaust. The air within this core flowpath may be referred to as "core air".

The core air is compressed by the first compressor rotor 34A and the second compressor rotor 34B and directed into a combustion chamber 52 of a combustor in the combustor section 50. Fuel is injected into the combustion chamber 52 and mixed with the compressed core air to provide a fuel-air mixture. This fuel-air mixture is ignited and combustion products thereof flow through and sequentially cause the second turbine rotor 36B and the first turbine rotor 36A to rotate. The rotation of the second turbine rotor 36B and the first turbine rotor 36A respectively drive rotation of the second compressor rotor 34B and the first compressor rotor 34A and, thus, compression of the air received from the airflow inlet. The rotation of the first turbine rotor 36A of FIG. 1 also drives rotation of the mechanical load 22 and its rotor 26. Where the mechanical load rotor 26 is configured as the propulsor rotor, the rotor 26 propels additional air through or outside of the gas turbine engine 20 to provide, for example, a majority of aircraft propulsion system thrust. Where the mechanical load rotor 26 is configured as the generator rotor, rotation of the rotor 26 facilitates generation of electricity.

Figure 2:
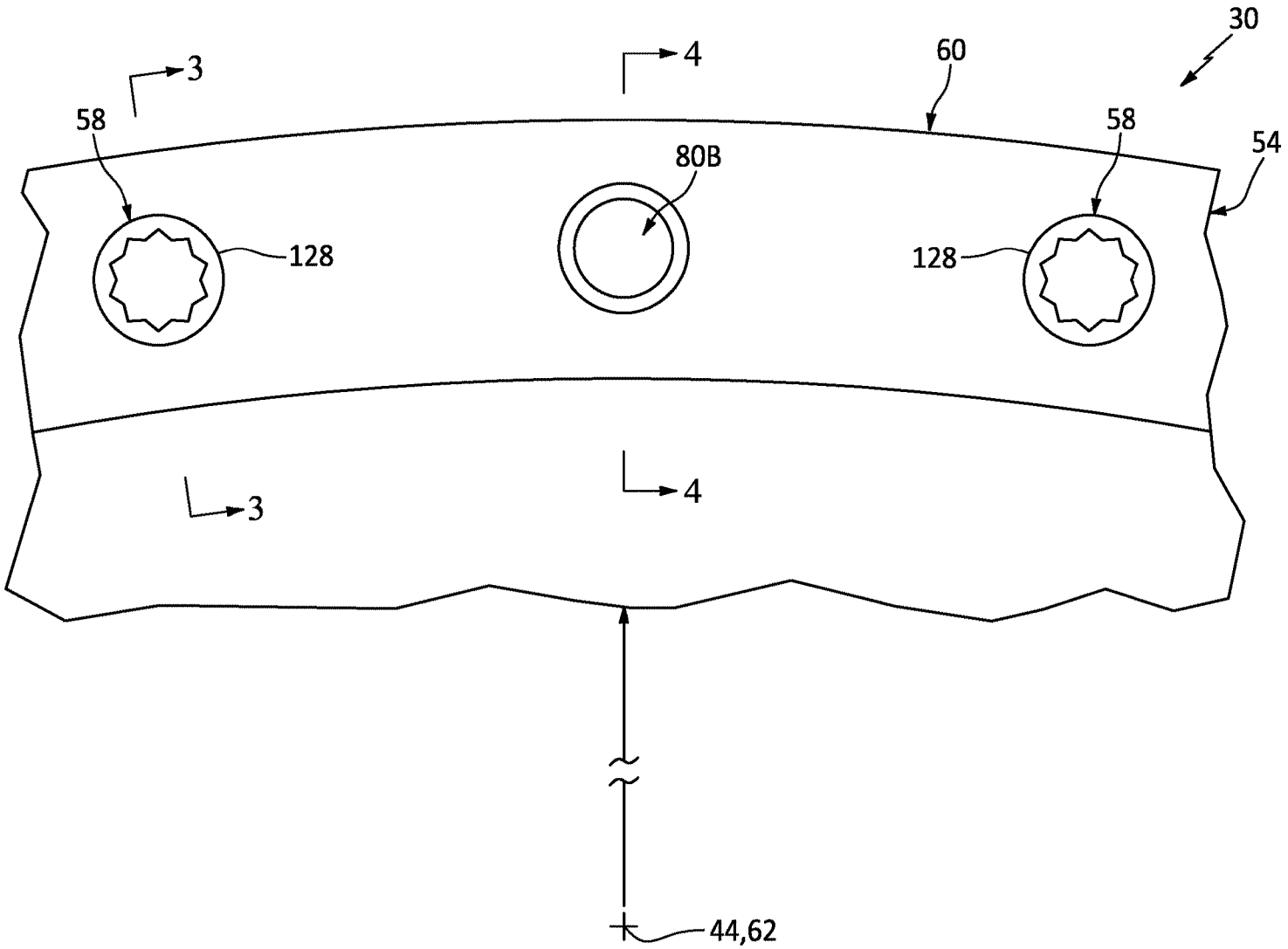
FIG. 2 is a partial illustration of a stationary structure at a mechanical joint.
Figure 3:
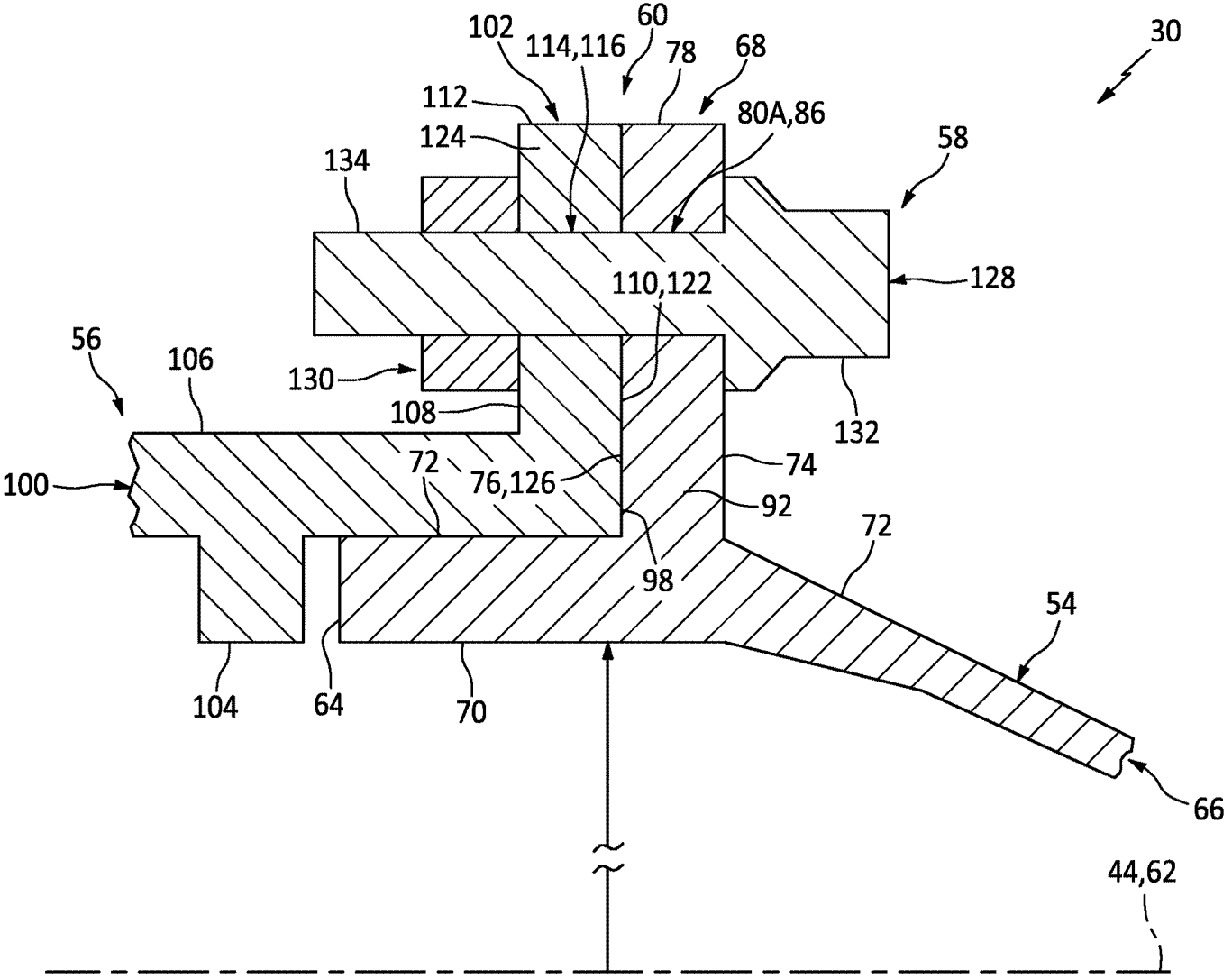
FIG. 3 is a partial side sectional illustration of the stationary structure at line 3-3 in FIG. 2.
Figure 4:
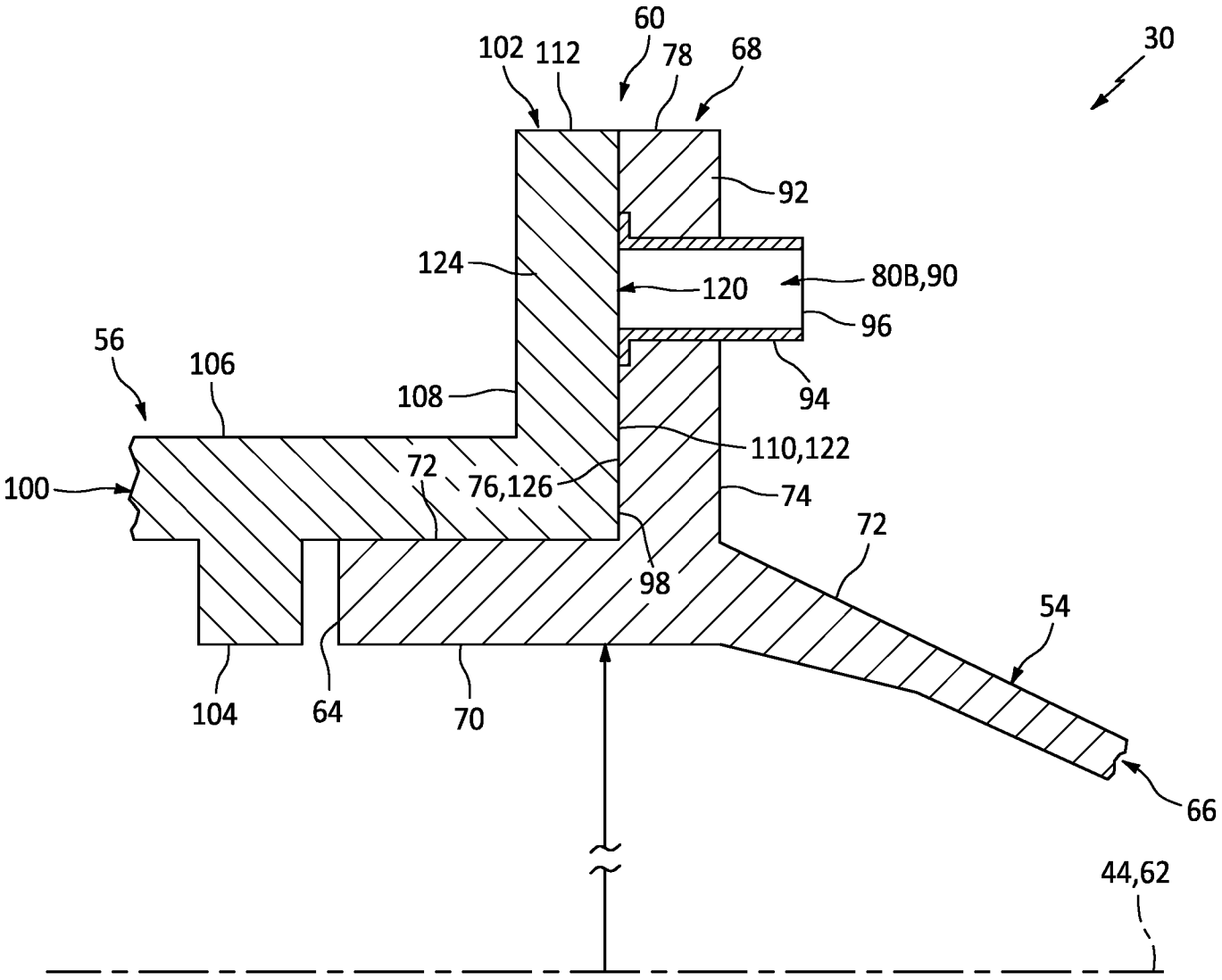
FIG. 4 is a partial side sectional illustration of the stationary structure at line 4-4 in FIG. 2.

FIGS. 2-4 illustrate a portion of the stationary structure 30. This stationary structure 30 includes a plurality of engine components 54 and 56 and a plurality of fastener assemblies 58 coupling the engine components 54 and 56 together at a mechanical joint 60.

The first engine component 54 may be configured as a tubular engine case for the gas turbine engine 20. The first engine component 54 of FIGS. 3 and 4, for example, extends axially along a centerline axis 62 of the stationary structure 30 to an (e.g., forward or aft) axial end 64 of the first engine component 54, which centerline axis 62 may be parallel and/or coaxial with the rotational axis 44. This first engine component 54 includes a first component base 66 and a first component mount 68; e.g., a flange and/or a rim.

The first component base 66 extends axially along the centerline axis 62 to the first component axial end 64. The first component base 66 extends circumferentially about (e.g., completely around) the centerline axis 62 (see also FIG. 5), which may thereby provide the first component base 66 with a tubular geometry. The first component base 66 extends radially between and to an inner side 70 of the first component base 66 and an outer side 72 of the first component base 66.

The first component mount 68 is connected to (e.g., formed integral with or otherwise bonded to) the first component base 66. The first component mount 68 is disposed at (e.g., on, adjacent or proximate) the first component axial end 64. The first component mount 68 of FIGS. 3 and 4, for example, extends axially along the centerline axis 62 between and to an axial first side 74 of the first component mount 68 and an axial second side 76 of the first component mount 68, where the first mount second side 76 is slightly recessed axially inward from the first component axial end 64. Of course, the first mount second side 76 may alternatively be axially aligned with the first component axial end 64 in other embodiments. The first component mount 68 extends circumferentially about (e.g., completely around) the centerline axis 62 and the first component base 66 (see also FIG. 5), which may thereby provide the first component mount 68 with an annular geometry. The first component mount 68 projects radially outward from the first component base 66 at the first base outer side 72 to a radial outer distal end 78 of the first component mount 68.

Figure 5:
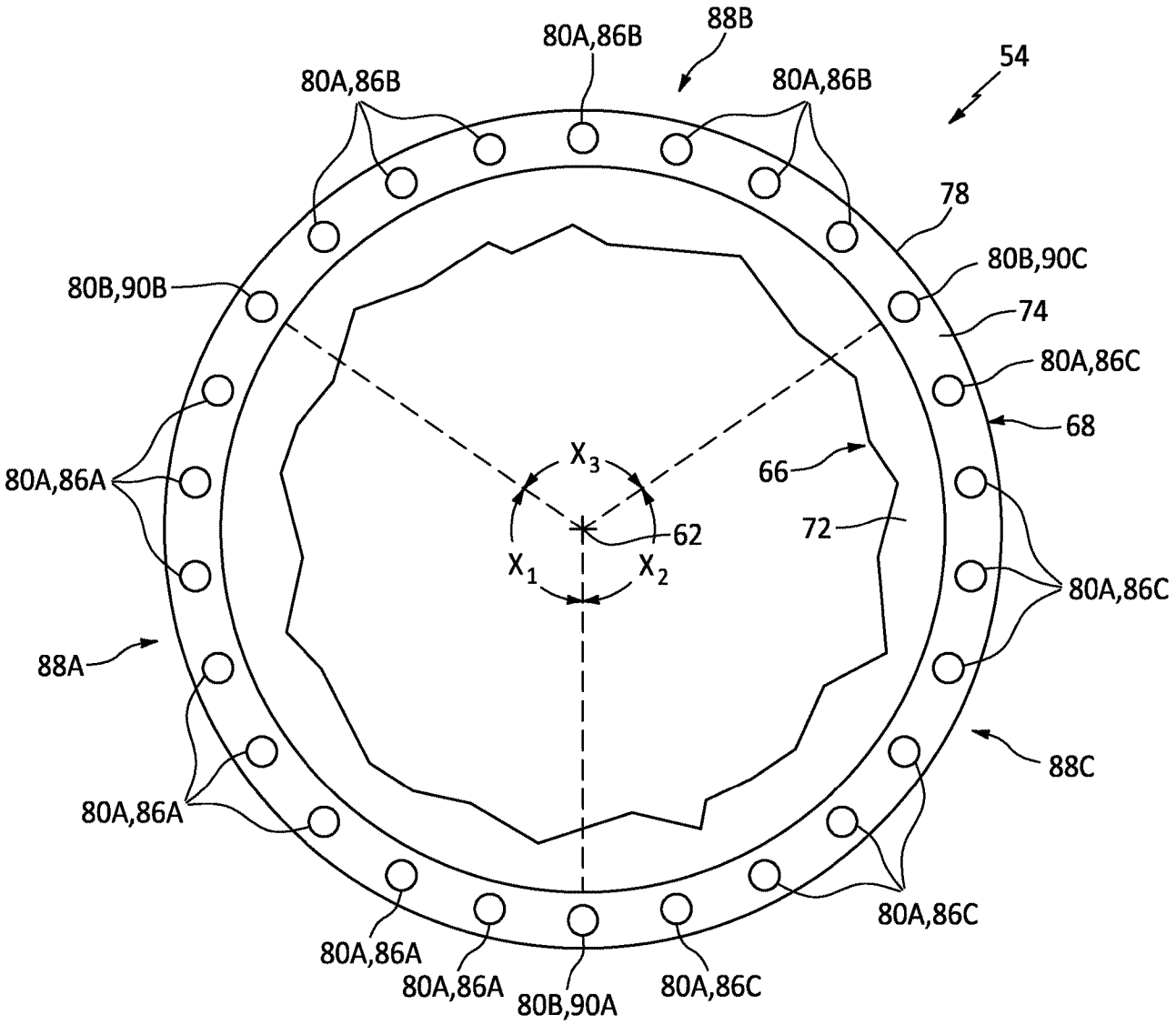
FIG. 5 is a partial illustration of the first engine component.
Figure 6:
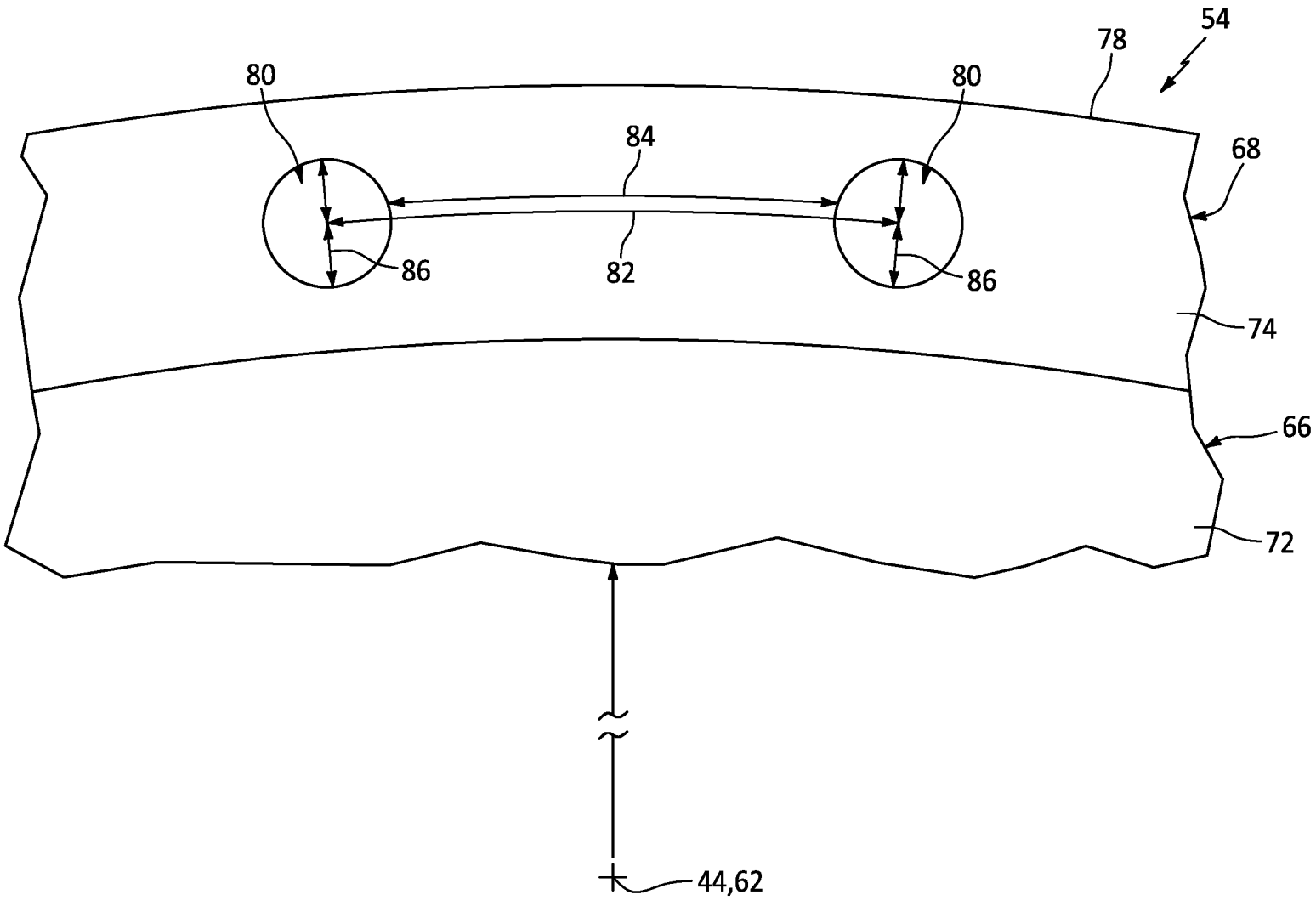
FIG. 6 is an enlarged illustration of a portion of the first engine component.

Referring to FIG. 5, the first component mount 68 is configured with a plurality of first component apertures 80A and 80B (generally referred to as "80"). These first component apertures 80 are arranged circumferentially about the centerline axis 62 in an annular array; e.g., a circular array. The first component apertures 80 may also be equally spaced circumferentially about the centerline axis 62. Each circumferentially neighboring pair of the first component apertures 80 of FIG. 6, for example, is spaced by a common (e.g., the same) circumferential distance 82. This circumferential distance 82 may be measured between centers of the respective circumferentially neighboring first component apertures 80. Outer peripheries of each of the circumferentially neighboring pairs of the first component apertures 80 may also (or alternatively) be separated by a common circumferential distance 84 where, for example, the first component apertures 80 have a common size 86; e.g., diameter.

The first component apertures 80A of FIG. 5 include NT-number of first fastener apertures 86A-C (generally referred to as "86") arranged into NFG-number of fastener aperture groups 88A-C (generally referred to as "88"), where the NT-number of first fastener apertures 86 is an odd number of first fastener apertures 86. The first component apertures 80B also include NIA-number of intergroup apertures 90A-C (generally referred to as "90") (e.g., spacer apertures and/or jacking apertures) interspersed/interposed with the fastener aperture groups 88, where the NIA-number of intergroup apertures 90 is equal to the NFG-number of fastener aperture groups 88.

Referring to FIGS. 3 and 4, each of the first component apertures 80A, 80B extends axially along the centerline axis 62 through the first engine component 54 and its first component mount 68. Each first fastener aperture 86 of FIG. 3, for example, is formed as an un-threaded through-hole in a base 92 of the first component mount 68. Each first fastener aperture 86 extends axially through the mount base 92 between and to the first mount first side 74 and the first mount second side 76. Each intergroup aperture 90 of FIG. 4 may be formed as a threaded bore in a respective insert 94 (e.g., a threaded insert, a jacking insert, etc.) mounted to the mount base 92. Each intergroup aperture 90 extends through the respective insert 94 (and thereby through the mount base 92) between and to the first mount second side 76 and an axial distal end 96 of the insert 94, where the insert 94 may project axially out from the first mount first side 74 to its distal end 96.

Referring to FIG. 5, the groups 88 of the first fastener apertures 86 include a first group 88A, a second group 88B and a third group 88C. The first group 88A of the first fastener apertures 86A is formed by $N_1$-number of the first fastener apertures 86A. The second group 88B of the first fastener apertures 86B is formed by $N_2$-number of the first fastener apertures 86B. The third group 88C of the first fastener apertures 86C is formed by $N_3$-number of the first fastener apertures 86C. The $N_1$-number of the first fastener apertures 86A may be the same as (e.g., equal to) the $N_3$-number of the first fastener apertures 86C. The $N_2$-number of the first fastener apertures 86B may be different (e.g., less) than the $N_1$-number of the first fastener apertures 86A and/or the $N_3$-number of the first fastener apertures 86C. The $N_1$-number and the $N_3$-number of the first fastener apertures 86A and 86C may each be an even number of the first fastener apertures 86A, 86C, and the $N_2$-number of the first fastener apertures 86B may be an odd number of the first fastener apertures 86B. Each of these fastener aperture groups 88 of FIG. 5 may be configured without any other apertures.

With the foregoing arrangement of the fastener aperture groups 88, the intergroup apertures 90 are asymmetrically spaced circumferentially about the centerline axis 62 and provide an integral alignment feature as described below in further detail. In particular, each intergroup aperture 90 is disposed between a circumferentially neighboring pair of the fastener aperture groups 88. More particularly, each intergroup aperture 90 is disposed between and circumferentially adjacent (A) one of the first fastener apertures 86 in a first of the circumferentially neighboring pair of the fastener aperture groups 88 and (B) one of the first fastener apertures 86 in a second of the circumferentially neighboring pair of the fastener aperture groups 88. Each circumferentially neighboring pair of the fastener aperture groups 88 of FIG. 5 may thereby be separated by (e.g., only) a single respective one of the intergroup apertures 90. The first intergroup aperture 90A is $X_1$-number of degrees from the second intergroup aperture 90B. The first intergroup aperture 90A is $X_2$-number of degrees from the third intergroup aperture 90C. The second intergroup aperture 90B is $X_3$-number of degrees from the third intergroup aperture 90C. The $X_1$-number of degrees may be the same as (e.g., equal to) the $X_2$-number of degrees. The $X_3$-number of degrees may be different (e.g., less) than the $X_1$-number of degrees and/or the $X_2$-number of degrees. However, the $X_3$-number of degrees may be within plus/minus two, five or ten degrees of the $X_1$-number of degrees and/or the $X_2$-number of degrees, or vice versa. It should be noted, the closer the $X_3$-number of degrees is to the $X_1$-number of degrees and/or the $X_2$-number of degrees, the more evenly loads and/or stresses will be distributed about the first component mount 68 and the joint 60 of FIGS. 2-4.

Referring to FIGS. 3 and 4, the second engine component 56 may be configured as a tubular engine case for the gas turbine engine 20. The second engine component 56 of FIGS. 3 and 4, for example, extends axially along the centerline axis 62 to an (e.g., aft or forward) axial end 98 of the second engine component 56. This second engine component 56 includes a second component base 100 and a second component mount 102; e.g., a flange and/or a rim.

The second component base 100 extends axially along the centerline axis 62 to the second component axial end 98. The second component base 100 extends circumferentially about (e.g., completely around) the centerline axis 62 (see also FIG. 7), which may thereby provide the second component base 100 with a tubular geometry. The second component base 100 extends radially between and to an inner side 104 of the second component base 100 and an outer side 106 of the second component base 100.

Figure 9:
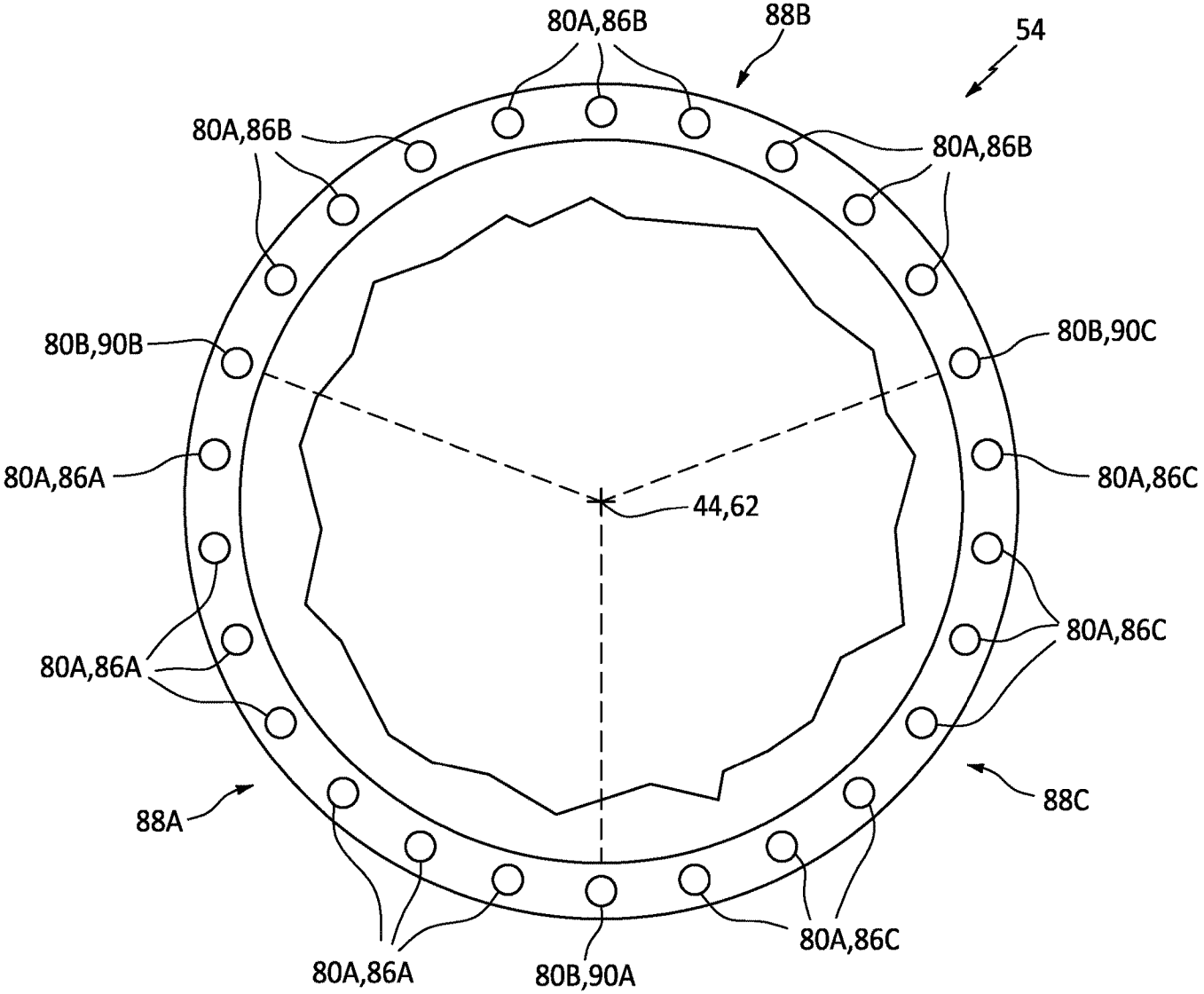
FIG. 9 is a partial illustration of the first engine component with another arrangement of apertures in its mount.

The second component mount 102 is connected to (e.g., formed integral with or otherwise bonded to) the second component base 100. The second component mount 102 is disposed at (e.g., on, adjacent or proximate) the second component axial end 98. The second component mount 102 of FIGS. 3 and 4, for example, extends axially along the centerline axis 62 between and to an axial first side 108 of the second component mount 102 and an axial second side 110 of the second component mount 102, where the second mount second side 110 is axially aligned with the second component axial end 98. Of course, the second mount second side 110 may alternatively be slightly recessed axially inward from the second component axial end 98 in other embodiments. The second component mount 102 extends circumferentially about (e.g., completely around) the centerline axis 62 and the first component base 66 (see also FIG. 9), which may thereby provide the second component mount 102 with an annular geometry. The second component mount 102 projects radially outward from the second component base 100 at the second base outer side 106 to a radial outer distal end 112 of the second component mount 102.

Figure 7:
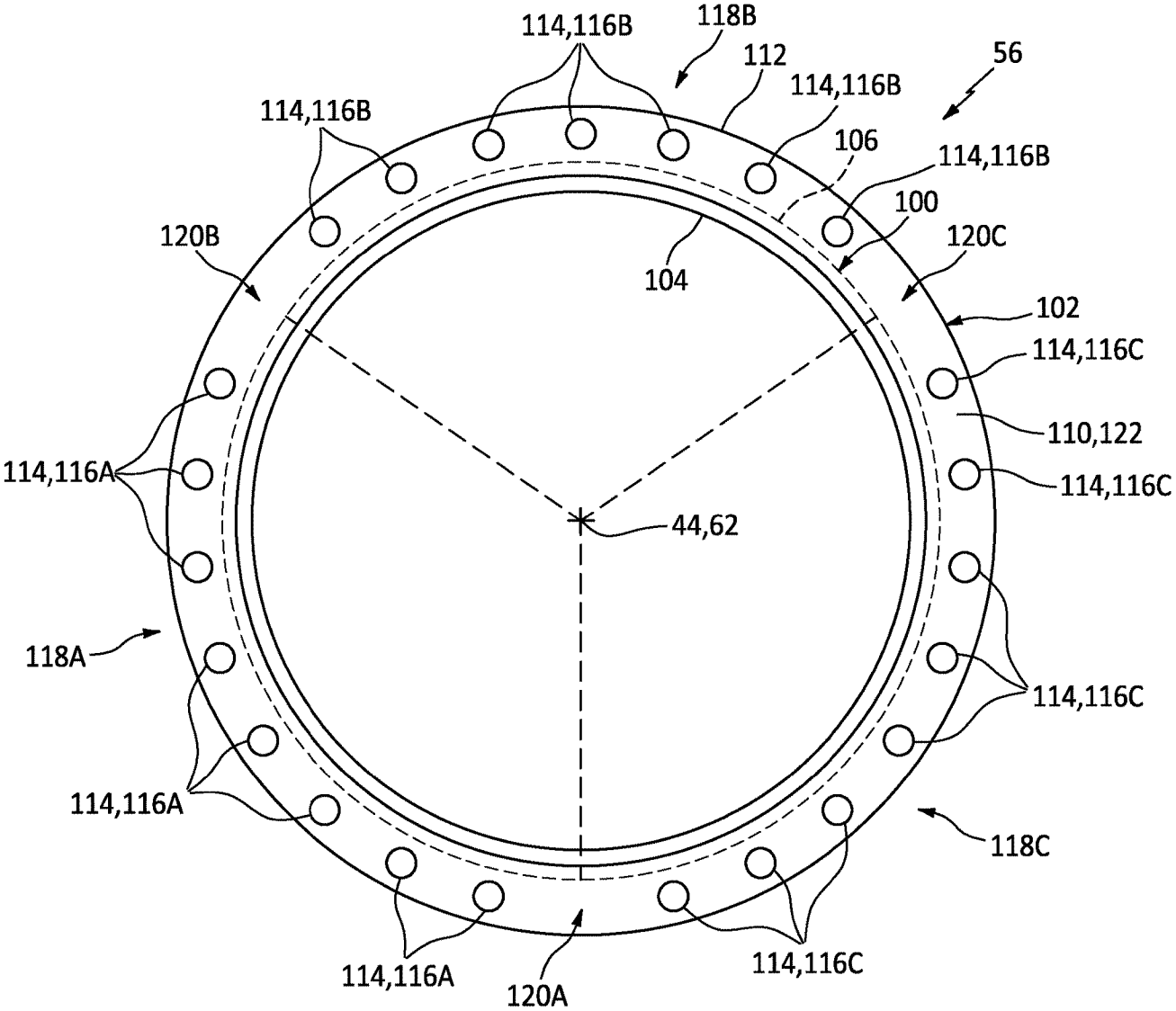
FIG. 7 is an illustration of the second engine component.

Referring to FIG. 7, the second component mount 102 is configured with a plurality of second component apertures 114. These second component apertures 114 are arranged circumferentially about the centerline axis 62 in an annular array; e.g., a circular array. Each of these second component apertures 114 may be configured as a second fastener aperture 116A, 116B or 116C (generally referred to as "116"). These second fastener apertures 116 are distributed circumferentially about the centerline axis 62 in a common pattern as the first fastener apertures 86 of FIG. 5; e.g., the second fastener apertures 116 and the first fastener apertures 86 have matching/complimentary patterns. The second fastener apertures 116 of FIG. 7, for example, are arranged into a plurality of groups 118A-C (generally referred to as "118"). The first group 118A of the second fastener apertures 116A may match (e.g., have the same number as and complimentary aperture positions to) the first group 88A of the first fastener apertures 86A of FIG. 5. The second group 118B of the second fastener apertures 116B may match the second group 88B of the first fastener apertures 86B of FIG. 5. The third group 118C of the second fastener apertures 116C may match the third group 88C of the first fastener apertures 86C of FIG. 5.

Whereas the first component apertures 80 of FIG. 5 include the intergroup apertures 90, the groups 118 of the second fastener apertures 116 of FIG. 7 are separated by non-perorated portions of the second component mount 102. A respective portion 120A-C (generally referred to as "120") of a surface 122 of the second component mount 102 at its second side 110, for example, is disposed between each circumferentially neighboring pair of the fastener aperture groups 118. More particularly, each portion 120 of the second mount surface 122 extends uninterrupted (e.g., without any apertures, protrusions and/or other interruptions) circumferentially between and to (A) one of the second fastener apertures 116 in a first of the circumferentially neighboring pair of the fastener aperture groups 118 and (B) one of the second fastener apertures 116 in a second of the circumferentially neighboring pair of the fastener aperture groups 118. These second mount surface portions 120 are distributed circumferentially about the centerline axis 62 in a common pattern as the intergroup apertures 90 of FIG. 5.

Referring to FIG. 3, each of the second fastener apertures 116 extends axially along the centerline axis 62 through the second engine component 56 and its second component mount 102. Each second fastener aperture 116 of FIG. 3, for example, is formed as an un-threaded through-hole in a base 124 of the second component mount 102. Each second fastener aperture 116 extends axially through the mount base 124 between and to the second mount first side 108 and the second mount second side 110.

Referring to FIGS. 3 and 4, the first engine component 54 and the second engine component 56 are arranged together at the mechanical joint 60. The second engine component 56, for example, may be translated (e.g., slid) axially over an end portion (e.g., an alignment portion) of the first component base 66 until the second component mount 102 axially engages the first component mount 68. The second mount surface 122, for example, may axially abut against and contact an axially opposing surface 126 of the first component mount 68 at its second side 76. At least one of the engine components 54, 56 is clocked (e.g., rotated) about the centerline axis 62 such that (A) each of the first fastener apertures 86 is aligned (e.g., coaxial) with a corresponding one of the second fastener apertures 116 (see FIG. 3) and (B) each of the intergroup apertures 90 is aligned with a corresponding one of the second mount surface portions 120 (see FIG. 4). More particularly, the first group 88A of the first fastener apertures 86A of FIG. 5 are respectively aligned with the first group 118A of the second fastener apertures 116A of FIG. 7. The second group 88B of the first fastener apertures 86B of FIG. 5 are respectively aligned with the second group 118B of the second fastener apertures 116B of FIG. 7. The third group 88C of the first fastener apertures 86C of FIG. 5 are respectively aligned with the third group 118C of the second fastener apertures 116C of FIG. 7. Similarly, the first intergroup aperture 90A of FIG. 5 is aligned with the first portion 120A of the second mount surface 122 of FIG. 7. The second intergroup aperture 90B of FIG. 5 is aligned with the second portion 120B of the second mount surface 122 of FIG. 7. The third intergroup aperture 90C of FIG. 5 is aligned with the third portion 120C of the second mount surface 122 of FIG. 7. Referring to FIG. 4, each intergroup aperture 90 may thereby extend axially through the first component mount 68 to the second mount surface 122; e.g., the second mount surface 122 covers (e.g., radially and circumferentially overlaps) each intergroup aperture 90. By clocking the engine components 54 and 56 in this fashion, proper circumferential alignment between the engine components 54 and 56 may be repeatably achieved without, for example, mistake.

Referring to FIGS. 2 and 3, the fastener assemblies 58 are mated with the fastener apertures 86 and 116 to secure the engine components 54 and 56 together. Each fastener assembly 58 of FIG. 3, for example, includes a fastener 128 (e.g., a bolt) and a nut 130. The fastener 128 of FIG. 3 includes a head 132 and a shank 134 connected to the head 132. The head 132 may be abutted against the first component mount 68 (or alternatively the second component mount 102). The shank 134 may project out from the head 132, sequentially through a respective first fastener aperture 86 and an aligned second fastener aperture 116 to a distal end portion. The nut 130 is mounted (e.g., threaded) onto the distal end portion and tightened to clamp the component mounts 68 and 102 together between the head 132 and the nut 130. With such an arrangement, each of the fastener apertures 86 and 116 receives (e.g., is plugged by) a respective one of the fasteners 128. However, each of the intergroup apertures 90 of FIGS. 2 and 4 is open; e.g., empty. The intergroup apertures 90 may remain open during operation of the gas turbine engine 20 of FIG. 1.

Figure 8B:
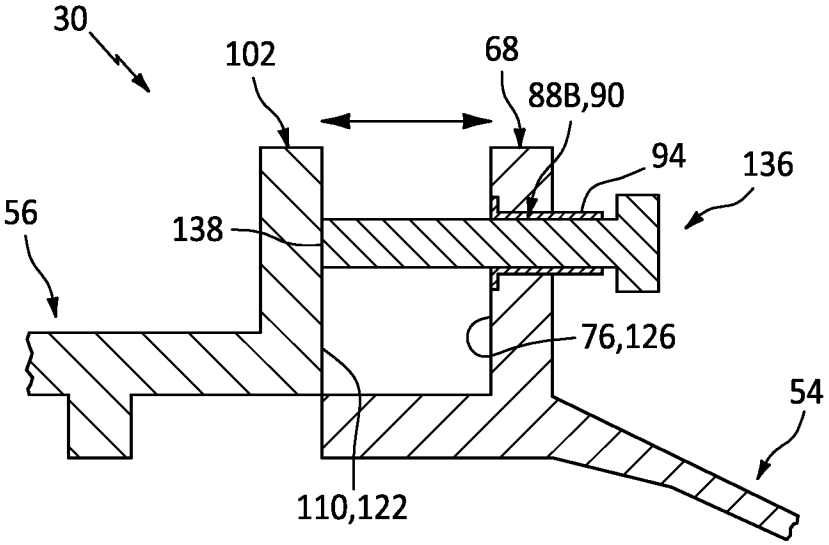
FIGS. 8A and 8B illustrate a sequence for disassembling the engine components.
Figure 8B:
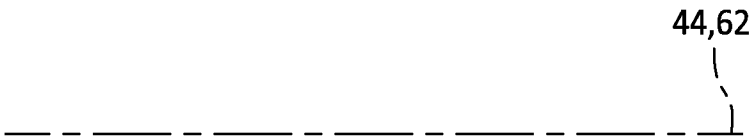
Figure 8A:
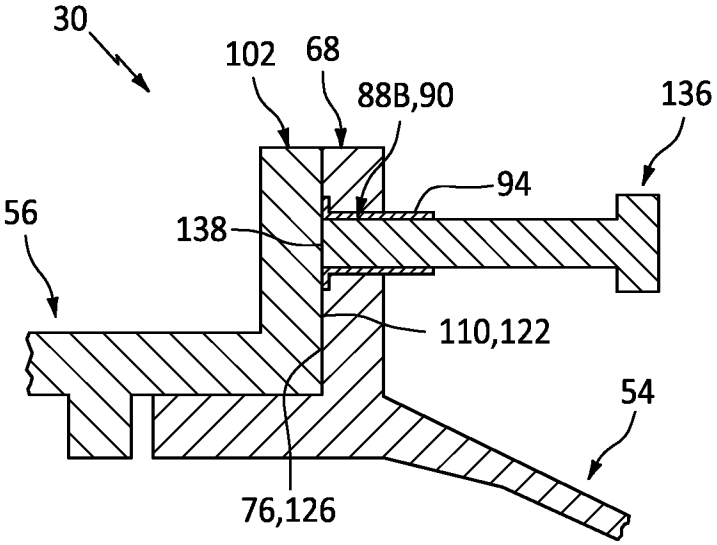
Figure 8A:
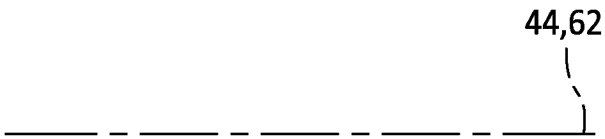

While the intergroup apertures 90 may remain open during gas turbine engine operation, each of the intergroup apertures 90 of FIGS. 8A and 8B may be mated with (e.g., receive) a respective tool during disassembly of the stationary structure 30; e.g., when the first engine component 54 is detached from the second engine component 56, or vice versa. Each tool may be configured as a jacking device. Each tool of FIG. 8A, for example, is configured as a bolt 136 which is threaded into the respective intergroup aperture 90. Each bolt 136 may be threaded until an end 138 of the bolt 136 engages (e.g., axially contacts) the second mount surface 122. After removal of the fastener assembly 58, each bolt 136 of FIG. 8B may continue to be threaded to press the second component mount 102 and its second mount surface 122 axially away from the first component mount 68 until, for example, the second engine component 56 is disengaged from the first engine component 54.

While the $N_1$-number and the $N_3$-number may be even numbers and the $N_2$-number may be an odd number as described above with respect to FIG. 5, the present disclosure is not limited to such an arrangement. For example, the $N_1$-number and the $N_3$-number may be odd numbers and the $N_2$-number may be an even number. In another example, referring to FIG. 9, the $N_1$-number, the $N_2$-number and the $N_3$-number may all be odd (or even) numbers as long as the $N_2$-number remains different than the $N_1$-number and the $N_3$-number.

While the first fastener apertures 86 of FIG. 5 are arranged into three groups 88, the present disclosure is not limited to such an arrangement. For example, the first fastener apertures 86 may be arranged into two fastener aperture groups 88 or four or more fastener aperture groups 88.

While the engine components 54 and 56 are described above as engine cases, the present disclosure is not limited to such an exemplary embodiment. One or both of the engine components 54, 56, for example, may each alternatively be configured as another component of the stationary structure 30 such as, but not limited to, an internal support structure. Examples of the internal support structure include, but are not limited to, a bearing support structure, a frame, a mid-turbine case, a vane array, etc.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure. Accordingly, the present disclosure is not to be restricted except in light of the attached claims and their equivalents.

What is claimed is:

1. A structure for a gas turbine engine, comprising:

a first engine component comprising a plurality of component apertures equally spaced circumferentially about an axis, the plurality of component apertures including a plurality of first fastener apertures and a plurality of intergroup apertures, the plurality of first fastener apertures arranged into a plurality of groups including a first group and a second group, the first group formed by $N_1$-number of the plurality of first fastener apertures, the second group formed by $N_2$-number of the plurality of first fastener apertures where the $N_2$-number is different than the $N_1$-number, and each of the plurality of intergroup apertures disposed circumferentially between and adjacent a respective circumferentially neighboring pair of the plurality of groups;

a second engine component comprising a surface and a plurality of second fastener apertures, the surface axially engaging the first engine component and covering the plurality of intergroup apertures; and a plurality of fasteners attaching the first engine component and the second engine component together, each of the plurality of fasteners mated with a respective one of the plurality of first fastener apertures and a respective one of the plurality of second fastener apertures.

2. The structure of claim 1, wherein the first engine component is configured as an engine case.

3. The structure of claim 1, wherein the first engine component further comprises a mount;

the mount extends circumferentially about the axis; and each of the plurality of component apertures extends axially through the mount.

4. The structure of claim 1, wherein a first of the plurality of intergroup apertures comprises a threaded aperture.

5. The structure of claim 1, wherein a first of the plurality of intergroup apertures is empty when the structure is assembled.

6. The structure of claim 1, wherein a first of the plurality of intergroup apertures is configured to mate with a tool during disassembly of the structure where the tool threads into the first of the plurality of intergroup apertures and presses axially against the surface.

7. The structure of claim 1, wherein the $N_1$-number is an even number.

8. The structure of claim 7, wherein the $N_2$-number is an odd number.

9. The structure of claim 8, wherein the first engine component is configured with a NT-number of the plurality of first fastener apertures, and the NT-number is an odd number.

10. The structure of claim 7, wherein the plurality of groups further includes a third group;

the third group is formed by $N_3$-number of the plurality of first fastener apertures; and the $N_3$-number is an even number.

11. The structure of claim 1, wherein the plurality of groups further includes a third group; and the third group is formed by $N_3$-number of the plurality of first fastener apertures where the $N_3$-number is different than the $N_2$-number.

12. The structure of claim 11, wherein the plurality of intergroup apertures include a first intergroup aperture disposed circumferentially between and adjacent the first group and the second group;

a second intergroup aperture disposed circumferentially between and adjacent the first group and the third group; and a third intergroup aperture disposed circumferentially between and adjacent the second group and the third group.

13. The structure of claim 12, wherein the $N_3$-number is equal to the $N_1$-number.

14. The structure of claim 1, wherein the plurality of intergroup apertures include a first intergroup aperture, a second intergroup and a third intergroup aperture;

the first intergroup aperture is $X_1$-number of degrees from the second intergroup aperture about the axis; and the first intergroup aperture is $X_2$-number of degrees from the third intergroup aperture about the axis where the $X_2$-number is equal to the $X_1$-number.

15. The structure of claim 1, wherein the second intergroup aperture is $X_3$-number of degrees from the third intergroup aperture about the axis where the $X_3$-number is within plus or minus five degrees of the $X_1$-number.

16. A structure for a gas turbine engine, comprising:

a first engine component comprising a first component mount and a plurality of component apertures arranged circumferentially about an axis, the first component mount extending circumferentially about the axis, each of the plurality of component apertures extending axially through the first component mount, the plurality of component apertures including a plurality of first fastener apertures and a spacer aperture where a first of the plurality of first fastener apertures is circumferentially between and adjacent a second of the plurality of first fastener apertures and the spacer aperture, and a circumferential spacing between the first of the plurality of first fastener apertures and the second of the plurality of first fastener apertures equal to a circumferential spacing between the first of the plurality of first fastener apertures and the spacer aperture;

a second engine component comprising a surface and a plurality of second fastener apertures, the surface circumferentially and radially overlapping the spacer aperture; and a plurality of fasteners attaching the first engine component and the second engine component together, each of the plurality of fasteners mated with a respective one of the plurality of first fastener apertures and a respective one of the plurality of second fastener apertures.

17. The structure of claim 16, wherein the spacer aperture is circumferentially between and adjacent the first of the plurality of first fastener apertures and a third of the plurality of first fastener apertures; and the circumferential spacing between the first of the plurality of first fastener apertures and the spacer aperture is equal to a circumferential spacing between the spacer aperture and the third of the plurality of first fastener apertures.

18. The structure of claim 17, wherein the third of the plurality of first fastener apertures is circumferentially between and adjacent the spacer aperture and a fourth of the plurality of first fastener apertures; and the circumferential spacing between the third of the plurality of first fastener apertures and the spacer aperture is equal to a circumferential spacing between the third of the plurality of first fastener apertures and the fourth of the plurality of first fastener apertures.

19. The structure of claim 16, wherein the plurality of component apertures further includes a plurality of intergroup apertures;

the plurality of first fastener apertures are arranged into a plurality of groups including a first group and a second group;

the first group is formed by $N_1$-number of the plurality of first fastener apertures including the first of the plurality of first fastener apertures and the second of the plurality of first fastener apertures;

the second group is formed by $N_2$-number of the plurality of first fastener apertures where the $N_2$-number is different than the $N_1$-number; and each of the plurality of intergroup apertures is disposed circumferentially between and adjacent a respective circumferentially neighboring pair of the plurality of groups, and the plurality of intergroup apertures includes the spacer aperture.

20. A structure for a gas turbine engine, comprising:

a first engine component comprising a plurality of component apertures equally spaced circumferentially about an axis, the plurality of component apertures including a plurality of first fastener apertures and a plurality of intergroup apertures, the plurality of first fastener apertures arranged into a plurality of groups including a first group and a second group, the first group formed by $N_1$-number of the plurality of first fastener apertures, the second group formed by $N_2$-number of the plurality of first fastener apertures where the $N_2$-number is different than the $N_1$-number, each of the plurality of intergroup apertures disposed circumferentially between and adjacent a respective circumferentially neighboring pair of the plurality of groups and;

a second engine component comprising a plurality of second fastener apertures; and a plurality of fasteners attaching the first engine component and the second engine component together, each of the plurality of fasteners mated with a respective one of the plurality of first fastener apertures and a respective one of the plurality of second fastener apertures;

wherein each of the plurality of intergroup apertures is empty following attachment of the second engine component to the first engine component.

* * * * *